United States Patent [19]

Kennedy et al.

[11] Patent Number: 4,986,049

[45] Date of Patent: Jan. 22, 1991

[54] INSULATED BUILDING BLOCK

[75] Inventors: Francis A. Kennedy; John P. Neff, both of Williamsville; Kenneth J. Blake, East Aurora, all of N.Y.

[73] Assignee: ThermaLock Products, Inc., North Tonawanda, N.Y.

[21] Appl. No.: 433,842

[22] Filed: Nov. 9, 1989

[51] Int. Cl.[5] ..... E04C 1/00

[52] U.S. Cl. ..... 52/309.12; 52/405; 52/612

[58] Field of Search ..... 52/309.11, 309.12, 405, 52/612, 570

[56] References Cited

U.S. PATENT DOCUMENTS

| | | | |
|---|---|---|---|
| 2,016,382 | 10/1935 | McBurney | 52/507 |
| 2,884,780 | 5/1959 | Ramirez | 52/507 |
| 3,653,170 | 4/1972 | Sheckler | 52/309.12 X |
| 3,984,957 | 10/1976 | Piazza | 52/612 X |
| 4,002,002 | 1/1977 | Barnhardt, Jr. | 52/309.12 |
| 4,055,928 | 11/1977 | Magerle | 52/405 |
| 4,123,881 | 11/1978 | Muse | 52/309.12 |
| 4,134,241 | 1/1979 | Walton | 52/405 |
| 4,185,434 | 1/1980 | Jones | 52/405 |
| 4,229,497 | 10/1980 | Piazza | 52/309.12 X |
| 4,263,765 | 4/1981 | Maloney | 52/405 |
| 4,312,164 | 1/1982 | Walt | 52/405 |
| 4,324,080 | 4/1982 | Mullins | 52/309.12 |
| 4,324,834 | 4/1982 | Page | 52/309.11 X |
| 4,348,845 | 9/1982 | Iannarelli | 52/405 |
| 4,380,887 | 8/1983 | Lee | 52/405 |
| 4,483,115 | 11/1984 | Schoenfelder | 52/309.12 |
| 4,551,959 | 11/1985 | Schmid | 52/309.12 |
| 4,589,240 | 5/1986 | Kendall | 52/309.11 |
| 4,628,653 | 12/1986 | Nash | 52/405 X |
| 4,754,587 | 7/1988 | Glaser | 52/309.11 |
| 4,833,852 | 5/1989 | West | 52/405 |
| 4,854,097 | 8/1989 | Haener | 52/309.11 |
| 4,856,248 | 8/1989 | Larson | 52/309.12 |

FOREIGN PATENT DOCUMENTS

| | | | |
|---|---|---|---|
| 32519 | 7/1981 | Fed. Rep. of Germany | 52/405 |
| 963760 | 1/1950 | France | 52/570 |
| 2561284 | 3/1984 | France | 52/405 |

*Primary Examiner*—Henry E. Raduazo
*Assistant Examiner*—Deborah McGann Ripley
*Attorney, Agent, or Firm*—Howard J. Greenwald

[57] ABSTRACT

An insulated, substantially rectangular building block is disclosed. The block contains two spaced, outer supportive parts which are interlockably connected with each other and which extend along the length of the block; and a curvilinear inner insulating material is present in the space between the supportive parts. Each of the outer supportive parts has a configuration which differs from that of the other such part. The insulating material is wedge-shaped, and it fits into a space between said supportive parts which is defined by walls which extend inwardly from the top of the building block to its bottom.

23 Claims, 7 Drawing Sheets

INSULATED BUILDING BLOCK

FIELD OF THE INVENTION

A building block containing two interlocking block parts separated from each other by an insulating material.

BACKGROUND OF THE PRIOR ART

Building blocks with improved insulating properties are well known to those skilled in the art. Thus, for example, a number of such building blocks are described in column 1 of U.S. Pat. No. 4,185,434 of Jones. As is disclosed in the Jones patent, most of the prior art building blocks contain webs or bridges across the ends and/or the middle of them between the cavities, and an unacceptable amount of heat is lost through these thermally conductive paths.

The Jones patent discloses a building block which does not contain connecting webs or bridges between its front and rear walls, which are maintained in spaced relationship by an insulating material between them; and it claims a wall construction comprised of a plurality of such building blocks. However, such wall construction may contain connecting mortar bridges or openings between the building blocks, and heat may readily flow from one side of a wall to the other.

The interior walls of the building block of the Jones patent define a multiplicity of right angles, and the interior surfaces of this building block create many stress points, thereby facilitating fracture upon the application of stress.

Another insulated building block is disclosed by U.S. Pat. No. 4,551,959 of Schmid. This building block has two spaced supportive parts separated from one another by a quantity of insulating material positioned between the parts. At column 2 of his patent, Schmid discloses a building block in which the insulating portion extends slightly beyond the confines of the space between its block parts so that, when the block is used in a wall in which adjacent blocks of like construction are joined with mortar, its insulating portion engages the insulating portion of an adjacent block and provides, with the insulating portion of adjacent blocks, a continuous barrier of insulation through the wall.

The two parts of the building block of the Schmid patent are held together by insulating material between such parts. When the block of the Schmid patent is subjected to conditions which will tend to degrade and/or weaken the insulating material (such as those one might encounter in a fire), the Schmid block will tend to lose its structural integrity.

It is an object of this invention to provide a building block which does not contain thermally conductive webs or bridges between the walls which allow the flow of heat from one wall to another.

It is another object of this invention to provide a building block which, when it is joined to one or more adjacent building blocks of similar construction with mortar, will form a wall construction which does not contain webs or bridges between its walls allowing the flow of heat from one side of the wall to the other.

It is yet another object of this invention to provide a building block which does not contain any large air cavities.

It is yet another object of this invention to provide a building block which will retain its structural integrity when the insulating material in it is weakened or destroyed.

It is yet another object of this invention to provide a building block which, when joined with mortar to building blocks of similar construction, will provide a construction wall which is less likely to crack when subjected to stress from earthquakes than prior art construction walls.

It is yet another object of this invention to provide a building block with improved sound insulating properties.

It is yet another object of this invention to provide a building block with improved heat storage properties.

SUMMARY OF THE INVENTION

In accordance with this invention, there is provided a substantially rectangular building block having two opposite and parallel sidewalls and two opposite and parallel ends. Two spaced, interlocking block parts extend along the length of the block sidewalls; and an insulating material is positioned within and fills the space between the block parts. At the top, bottom, and each of the sides of the block, the insulating material extends slightly beyond the confines of the space between its block parts.

BRIEF DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

Figure 1:
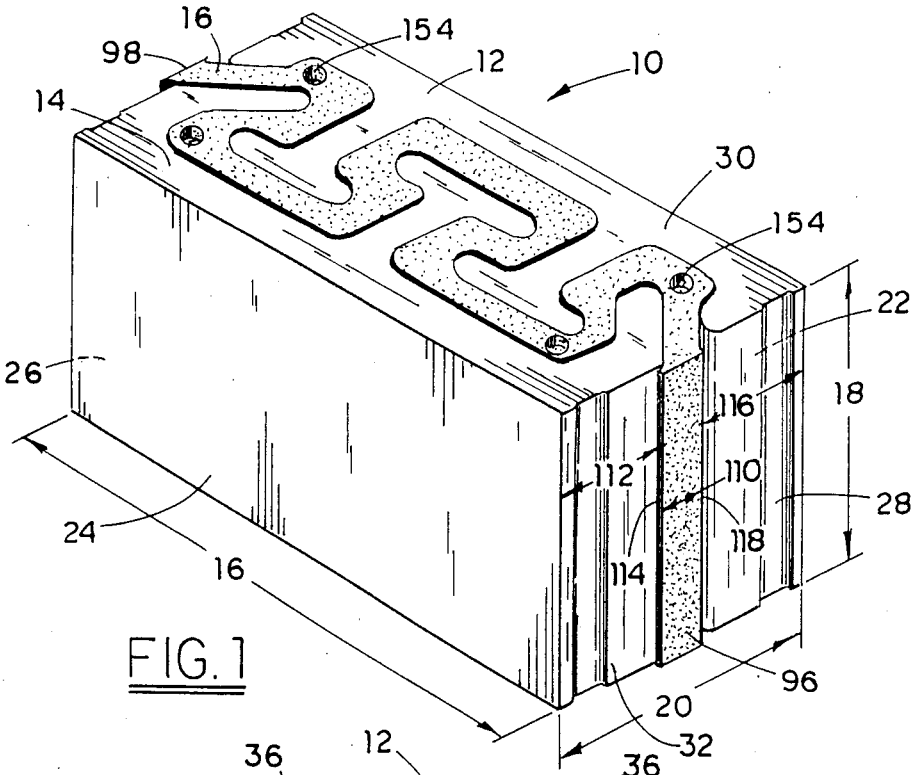
FIG. 1 is a perspective view of one of the preferred building blocks of applicants' invention.

FIG. 1 is a perspective view of one preferred embodiment of the building block 10 of applicants' invention. Building block 10 preferably has a rectangular shape and is comprised of two interlocking outer supportive parts, 12 and 14, and an inner insulation portion 16.

Outer supportive part 12 and outer supportive part 14 may be made by conventional means from any cementitious material, baked clay, or other material. It is preferred that outer supportive parts 12 and 14 be made from any cementitious material which acts as a bonding agent for materials.

In one embodiment, outer supportive parts 12 and 14 are made with a CINVA-Ram block press using a mixture of soil, sand, silt, clay, and cement; the press has a mold box in which a hand-operated piston compresses a slightly moistened mixture of soil and cement or lime. This process is described in, e.g., a publication entitled "Making Building Blocks with the CINVA-Ram Block Press," (Volunteers in Technical Assistance, Mt. Ranier, Md., 1977), the disclosure of which is hereby incorporated by reference into this specification.

In another embodiment, outer supportive parts 12 and 14 are made with a Besser Vibrapac V3R block machine (available from the Besser Manufacturing Company of Alpena, Mich.) with a hydraulic cement.

Hydraulic cements are produced by burning an intimate mixture of finely divided calcareous and argillaceous materials and grinding the resulting clinker to a fine powder, usually with gypsum to retard the set. The calcining process produces calcium silicates and calcium aluminates that can react chemically with water to form a hard, stone-like mass. When mixed with sand, coarse aggregate, and water, these cements produce mortars and concretes.

In one preferred embodiment, outer supportive parts 12 and 14 each consist essentially of concrete. Concrete is a composite material composed of coarse granular material (the aggregate or filler) embedded in a hard matrix of material (the cement or binder) that fills the space between the aggregate particles and glues them together. Any of the concretes known to those skilled in the art may be used to prepare parts 12 and 14. Thus, by way of illustration and not limitation, one may use any of the concretes disclosed in S. Mindess' "Concrete" (Prentice Hall, Inc., Englewood Cliffs, N.J., 1981), the disclosure of which is hereby incorporated by reference into this specification.

The building block 10 is preferably sized on a multiple of 2 inches and preferably has the same dimensions of concrete blocks in common use; see, e.g., pages 179–181 of L. M. Detzettel's "Masons and Builders Library," Volume 1 (Macmillan Publishing Company, New York, 1986), the disclosure of which is hereby incorporated by reference into this specification.

In one embodiment, building block 10 has a length 16 of from about 15 to about 17 inches and, more preferably, from about 15.3 to about 15.8 inches. In this embodiment, the height 18 of building block 10 may be from 7 to about 9 inches (and, preferably, from about 7.4 to about 7.8 inches) or, alternatively, from about 3 to about 4 inches (and, preferably, from about 3.3 to about 3.8 inches). In this embodiment, the width 20 of building block 10 is from about 7 to about 9 inches and, preferably, from about 7.3 to about 7.8 inches. In another embodiment, not shown, width 20 may be from about 6 to about 12 inches.

Building block 10 preferably has two opposite planar sidewalls 22 and 24, two opposite planar ends 26 and 28, a planar top 30, and a planar bottom 32. The block sidewalls 22 and 24 are preferably parallel to each other, the block ends 26 and 28 are preferably parallel to each other, and the block top 30 and bottom 32 are preferably parallel to each other. The block sidewalls 22 and 24 are substantially perpendicular to the block top 30 and bottom 32. The block top 30 and bottom 32 are substantially perpendicular to the block ends 26 and 28.

It is preferred that endwalls 26 and 28 have substantially the same width, both of them preferably being from about 6 to about 12 inches. In one embodiment, each of endwalls 26 and 28 is 6 inches. In one embodiment, each of endwalls 26 and 28 is 8 inches. In one embodiment, each of endwalls 26 and 28 is 10 inches. In one embodiment, each of endwalls 26 and 28 is 12 inches.

Building block 10 is comprised of means for preventing the separation of outer supportive parts 12 and 14. Any means for preventing the separation of such parts 12 and 14 known to those skilled in the art may be used. Thus, by way of illustration and not limitation, one may use the means described in "Ingenious Mechanisms for Designers and Inventors," Volumes I, II, III, and IV (Industrial Press Inc., New York, 1978), the disclosure of which are hereby incorporated by reference into this specification.

In one preferred embodiment, each of outer supportive parts 12 and 14 are so shaped that they contain curvilinear interlocking structure associated with them; this embodiment is illustrated in FIGS. 2, 4, 5, 6, 7, 8, 9, and 10.

Figure 4:
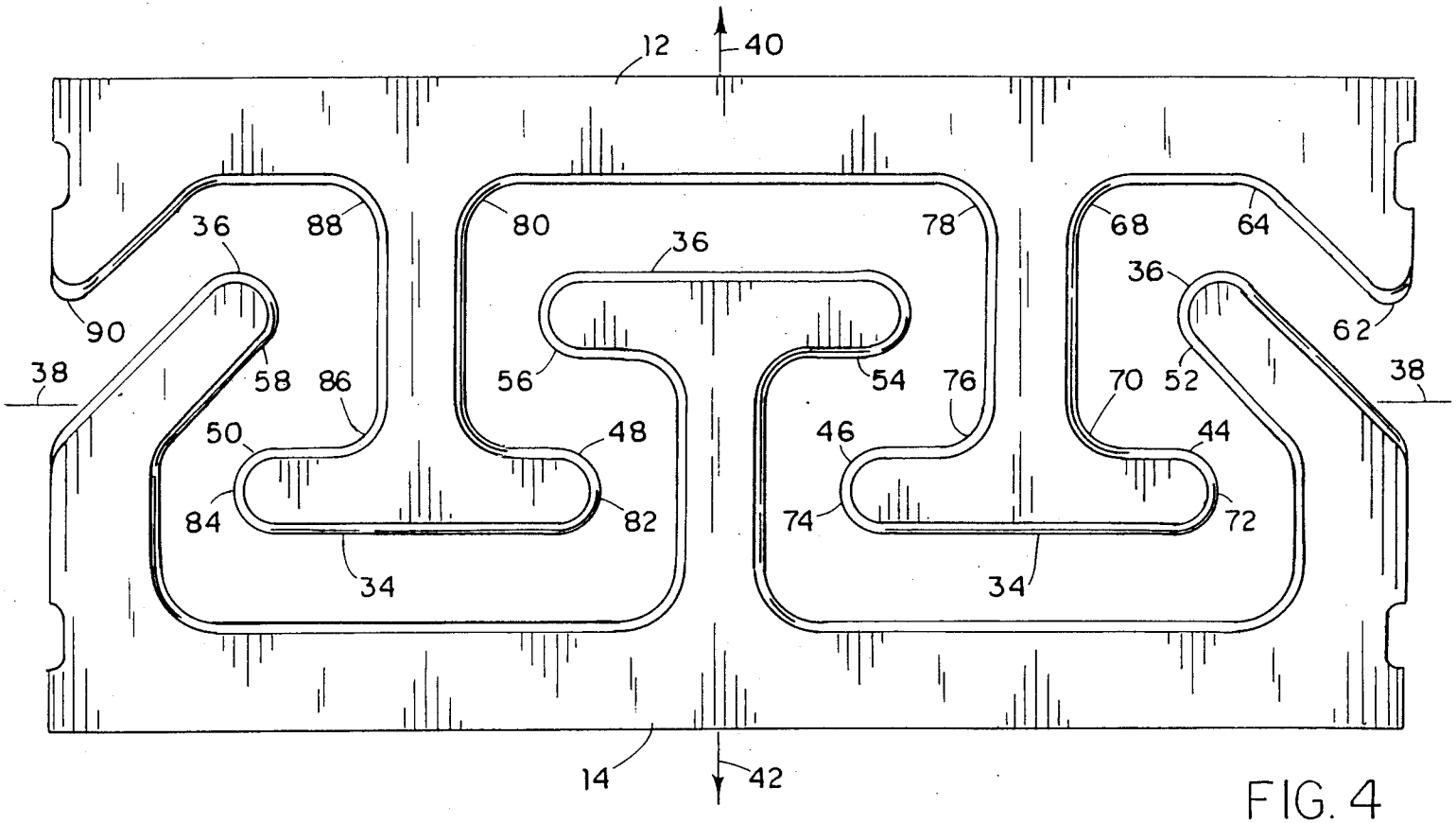
FIG. 4 is a top view of the interlocking block parts of the building block of FIG. 1 from which view, for the sake of illustration, the insulating material of the block of FIG. 1 has been omitted.

Referring to FIG. 4, each of outer supportive parts 12 and 14 are preferably integral pieces having at least one internal section, 34 and 36 respectively, so shaped to enable a portion of each of parts 12 and 14 to project within the confines of the other block part. Referring to FIG. 4, the centerline between block parts 12 and 14 is line 38. The projection(s) 34 extending from outer supportive part 12 projects past centerline 38 into the the confines of block part 14, and the projection(s) 36 extending from outer supportive part 14 projects past centerline 38 into the confines of block part 12.

Outer supportive parts 12 and 14 are laterally interlockably connected to each other. When forces are applied in lateral directions 40 and 42 tending to pull parts 12 and 14 away from each other, these block parts 12 and 14 will travel only a certain distance until the interior surfaces of projections 34 and 36 contact each other and prevent further lateral movement. Thus, referring to FIG. 4, interior surfaces 44, 46, 48, and 50 of projections 34 will contact interior surfaces 52, 54, 56, and 58 of projections 36 and preclude further lateral movement of block parts 12 and 14.

Figure 9:
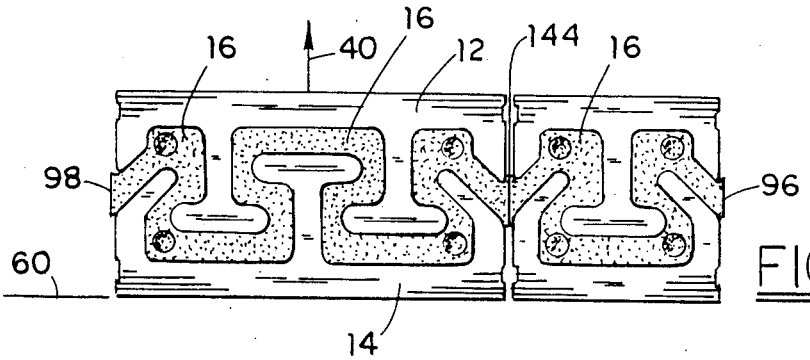
FIG. 9 is a top view of one means of joining the building block of FIG. 1 with the building block of FIG. 8.

The lateral interlocking of block parts 12 and 14 prevents the lateral separation of block 10 even after insulating portion 16 within the block has deteriorated or been destroyed. A simple test can be used to demonstrate this interlocking feature. Referring to FIG. 9, in this test building block 10 is placed upon a flat surface 60, and the insulating portion 16 is then removed from the block without disturbing the relative positions of block parts 12 and 14. The insulating portion 16 may be mechanically removed from the block. Alternatively, or additionally, it may be burned out of the block by heating the block for a time and temperature sufficient to vaporize most of the material in the insulating material. Other means of removing the insulating material will be apparent to those skilled in the art.

Once insulating material 16 has been removed from the block 10, force is applied to outer block part 12 to lift it in the direction of arrow 40 until it is at a height of 3.0 feet above surface 60. Because outer block parts 12 and 14 are still laterally interlockably connected even after insulative portion 16 has been removed, the lifting of part 12 above surface 60 will also result in the lifting of part 14 above surface 60.

FIG. 4 illustrates but one of many curvilinear, interlocking structures which may be used to laterally interlockably connect outer block parts 12 and 14; and other such structures will be readily apparent to those skilled in the art. One structure which it is preferred not to use, however, is disclosed in U.S. Pat. No. 4,185,434 of Jones, the disclosure of which is hereby incorporated by reference into this specification.

The Jones patent discloses a building block with a first parallel wall and a second parallel wall, each of which are formed on separate block parts 4 and 5, and each of which have internal sections 4' and 5', respectively. The internal sections 4' and 5' are shaped to enable a portion of one block part 4 to project within the confines of the other block part 5.

The edges of the internal sections 4' and 5' of the Jones patent are rectilinear, that is, they are characterized by and bounded by straight lines forming right angles. Thus, as is shown in FIG. 1 of Jones, each of the surfaces of internal sections 4' and 5' of the Jones block is defined by two straight lines which intersect to form a right angle.

Referring again to FIG. 4, it can be seen that the projections 34 and 36 used to interlockably connect block parts 12 and 14 are not rectilinear, that is, in no portion of these projections is a right angle defined by intersecting surfaces. The inner surfaces of building block 10, thus, preferably includes a multiplicity of corners, each of which is rounded. Thus, referring to FIG. 4, it will be seen, for example, that none of the intersecting surfaces 62, 64, 68, 70, 72, 74, 76, 78, 80, 82, 84, 86, 88, and 90 of projections 34 of block part 12 are rectilinear; each of these surfaces are curvilinear; they are formed, bounded, and characterized by curved lines.

Without wishing to be bound to any particular theory, applicants believe that the absence of rectilinear interior surfaces in their building block improves the fracture resistance of such block.

Figure 2:
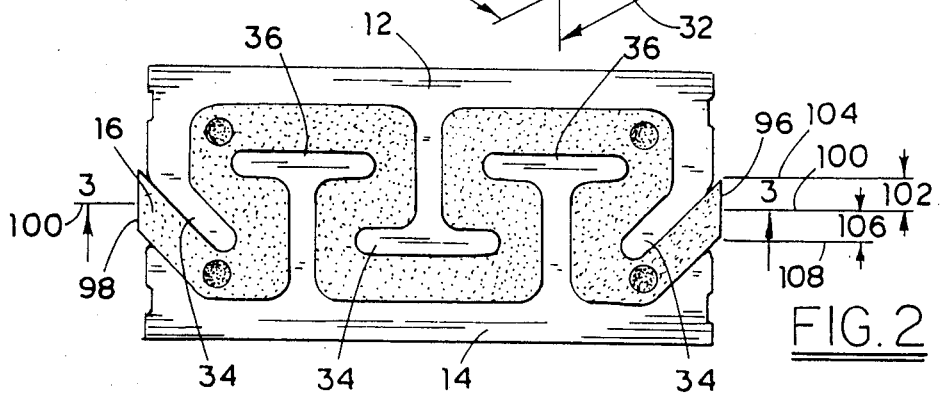
FIG. 2 is a top view of the building block of FIG. 1.
Figure 3:
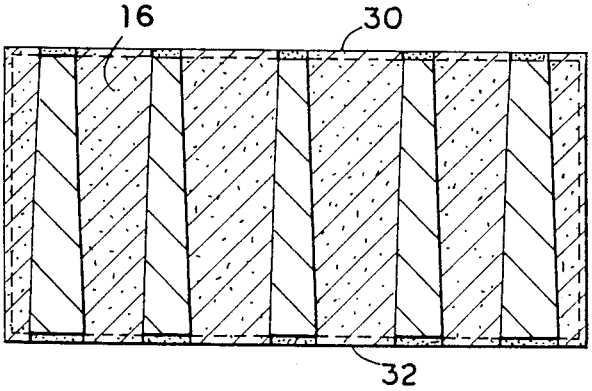
FIG. 3 is a cross-sectional view, taken along line 3—3 of FIG. 2, of the building block of FIG. 2.

FIG. 3 is a cross-sectional view of the preferred embodiment of FIG. 2 showing that, in this preferred embodiment, each of block parts 12 and 14 contains projections (34 and 36) which extend divergingly from the top 30 to the bottom 32 of block 10. Each of the projections is wider at the bottom 32 of the block than at its top 30; conversely, the insulating portion 16 is wider at the top 30 than at the bottom 32.

Figure 5:
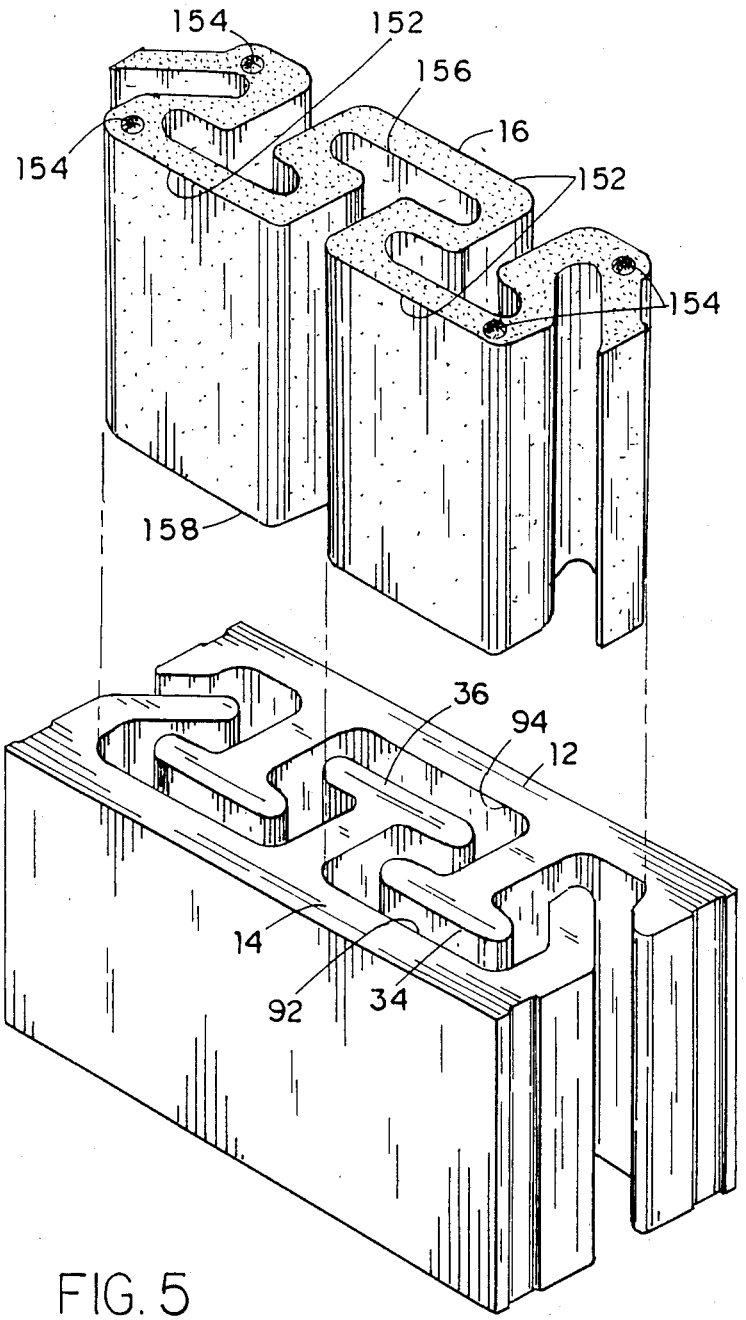
FIG. 5 is a perspective view of one preferred process of applicants' invention in which the insulating material of the building block of FIG. 1 is inserted between the interlocking block parts of said building block.

FIG. 5 illustrates a means of constructing the building block 10 of this invention. Referring to FIG. 5, it will be seen that each of outer supportive parts 12 and 14 may be disposed with regard to each other that the tops of projections 34 and 36 are separated from the interior opposing surfaces 92 and 94 of parts 14 and 12, respectively, by a distance approximately equal to or slightly larger than the top width of insulating material 16. Thereafter, insulating material 16 is inserted into and between block parts 12 and 14, snugly fitting into the wedgeshaped crevices formed by projections 32 and 34 and locking parts 12 and 14 together.

Insulating portion 16 of building block 10 is preferably so dimensioned so that it extends slightly beyond the confines of endwalls 26 and 28, block top 30, and/or block bottom 32. Because of this feature, when one of building blocks 10 is joined to another of such blocks either endwall to endwall or top to bottom, a continuous thermal barrier is formed between the adjacent blocks. There is no thermal pathway through which heat can travel from one side of a wall built with building block 10 to another side of a wall built with building block 10.

Referring to FIG. 2, which is a top view of the building block of FIG. 1, it will be seen that insulating portion 16 preferably consists of an integral piece of insulating material and extends the entire length of the block 10 and beyond planar endwalls 26 and 28 of block 10. Ends 96 and 98 of insulating portion 16 preferably extend from about 0.2 to 0.4 inches beyond endwalls 26 and 28, respectively.

Two or more of building blocks 10 may be joined end to end by mortar to forming a construction wall which contains a continuous barrier of insulation throughout the wall and provides no thermal path for the travel of heat from sidewall 22 to sidewall 24. This is accomplished because each of building blocks 10 has an insulating portion which extends slightly beyond the confines of both endwall 26 and endwall 28 so that, when two or more of such blocks are joined with mortar, substantially a single building block 10 is formed.

Builing blocks 10 are so constructed that, regardless of how one endwall of one block is joined with another endwall of a second block, the resulting structure will have a continuous barrier of insulation throughout it. Thus, endwall 26 of one block may be joined to endwall 28 of another block. Alternatively, endwall 26 of one block may be joined to endwall 26 of another block, or endwall 28 of one block may be joined to endwall 28 of another block. Regardless of how endwalls 26 and 28 are connected to endwalls of similar blocks, the resulting construction wall will always contain a continuous thermal barrier, and there will be no thermal path between sidewalls 22 and 24. This feature is especially important when substantially unskilled labor is used to lay building blocks 10, for it makes it more difficult for such a laborer to install the block in a wrong manner.

The ends 96 and 98 of insulating portion 16 which extend beyond walls 28 and 26, respectively, are substantially at the center of said walls 28 and 26. Referring to FIG. 2, a centerline 100 can be drawn between sidewalls 22 and 24, and the portion of the insulating material 16 which extends beyond the, endwall is substantially centered on both sides of the centerline.

The term substantially centered, as used in this specification, means that at least some portion of end 96 and of end 98 is on each side of the centerline 100. Thus, referring to FIG. 2, the distance 102 between centerline 100 and the distal portion 104 of end 96 is from about 0.25 to 4 times as great as the distance 106 between centerline 100 and the proximal portion 108 of end 96. Similarly, the distances between the distal and proximal portions of end 98 (not shown) and centerline 100 are from aobut 0.25 to about 4 times as great as each other. It is preferred that the distances between the distal and proximal portions of ends 96 and 98 and the centerline 100 be from about 0.33 to about 3.0 times each other. In one embodiment, said distances are from about 0.4 to about 2.0 times each other.

In FIG. 1, the thickness 110 of ends 96 and 98 at their midpoint of insulating portion 16 is such that the distance 112 from wall 24 to the inner wall 114 of end 96 is from about 0.8 to about 1.2 times the distance 116 from wall 28 to the outer wall 118 of end 96. Similarly, the distance from wall 20 to the inner wall of end 98 is from about 0.8 to about 1.2 times the distance from wall 18 to the outer wall of end 98.

The intersection of sidewalls 22 and 24 with endwalls 26 and 28, respectively, preferably defines a substantially 90 degree angle.

At the point at which ends 96 and 98 extend past the ends of walls 26 and 28, the width of insulating portion 110 at its midpoint is preferably from about 1 to about 3 inches and, more preferably, from about 1.25 to about 2.5 inches.

It is preferred that the ratio of the width of the insulating portion 16 at its midpoint and at the points at which ends 96 and 98 extend past the ends of walls 26 and 28, to the distance between sidewalls 22 and 24, be from about 0.10 to about 0.5. It is more preferred that said ratio be from about 0.15 to about 0.35 percent. In a more preferred embodiment, said ratio is from about 0.16 to about 0.26.

Figure 6:
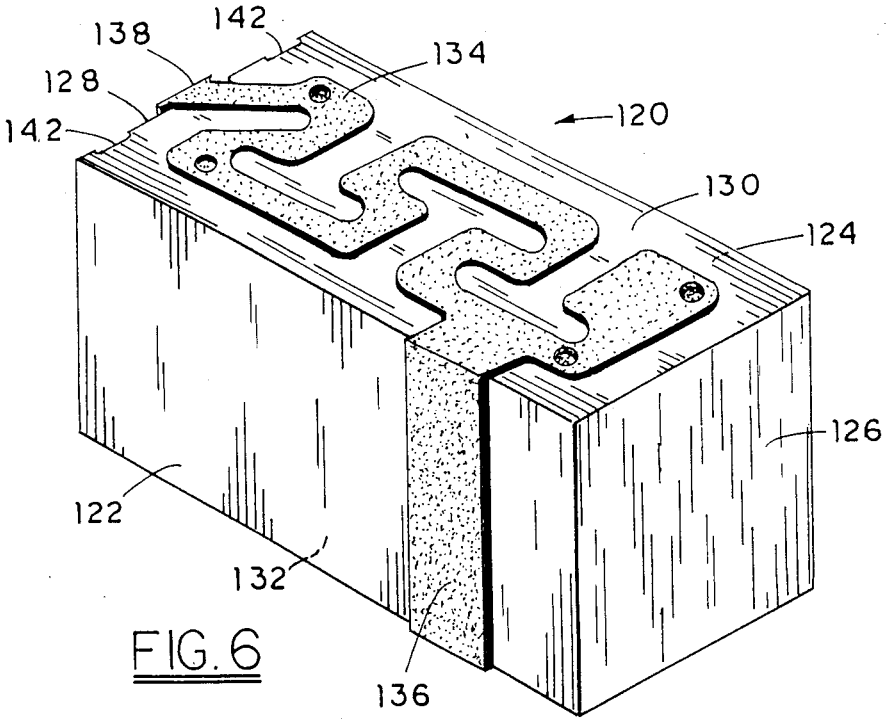
FIG. 6 is a perspective view of one preferred embodiment of an end building block.

Referring to FIG. 6, there is shown an alternative building block, generally indicated as 120, which is suited for use at a corner of a wall construction. Building block 120 preferably has two opposite planar sidewalls 122 and 124, two opposite planar ends 26 and 28, a planar top 130, and a planar bottom 132. The block sidewalls 122 and 124 are preferably parallel to each other, the block ends 126 and 128 are preferably parallel to each other, and the block top 130 and bottom 132 are preferably parallel to each other. The block sidewalls 122 and 124 are substantially perpendicular to the block top 130 and bottom 132. The block top 130 and bottom 132 are substantially perpendicular to the block ends 126 and 128.

Insulating portion 134 is an integral article extending from endwall 128 to side wall 122. Insulating portion 134 preferably extends beyond planar walls 122 and 128. Ends 136 and 138 of insulating portion 134 preferably extend from about 0.2 to 0.4 inches beyond walls 122 and 128.

Figure 7:
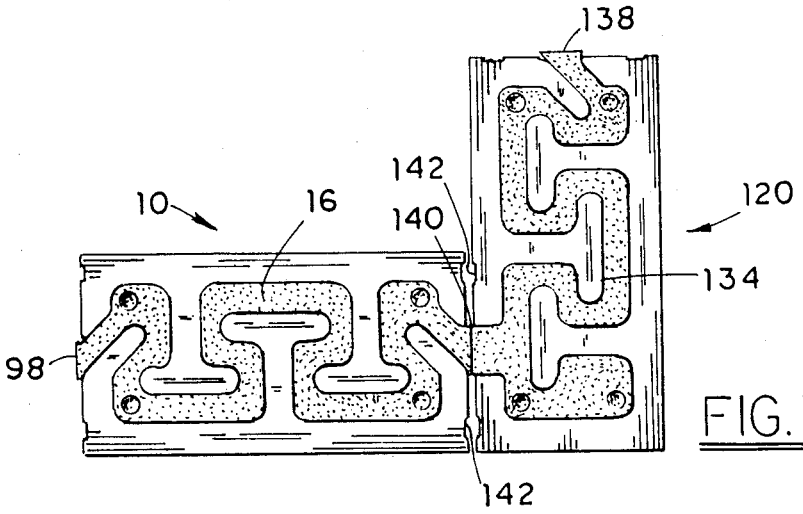
FIG. 7 illustrates one means of joining the building block of FIG. 1 with the building block of FIG. 6.

Referring to FIG. 7, the use of both block 10 and end block 138 is used. It should be noted that, at point 140, there is a continuous insulative path formed by the contact between insulating material 16 and insulating matertial 134.

Referring again to FIGS. 6 and 7, in the embodiments of the building blocks shown, mortar notches are provided which preferably extend the full height of block 10 and block 120.

Figure 8:
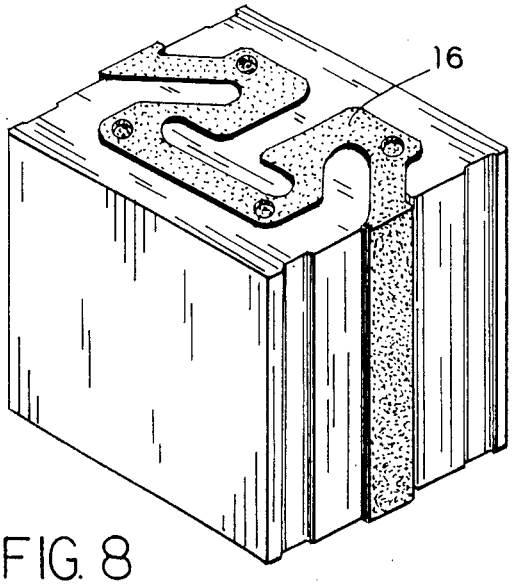
FIG. 8 is a perspective view of another embodiment of a half-block building block of this invention.

FIG. 8 illustrates another, smaller-sized version of the building block of FIG. 1. FIG. 9 shows one means of connecting the building block of FIG. 1 with the building block of FIG. 8. It should be noted that, at point 144, there is contact between the insulating portions 16, thereby providing a continuous insulating path.

Figure 10:
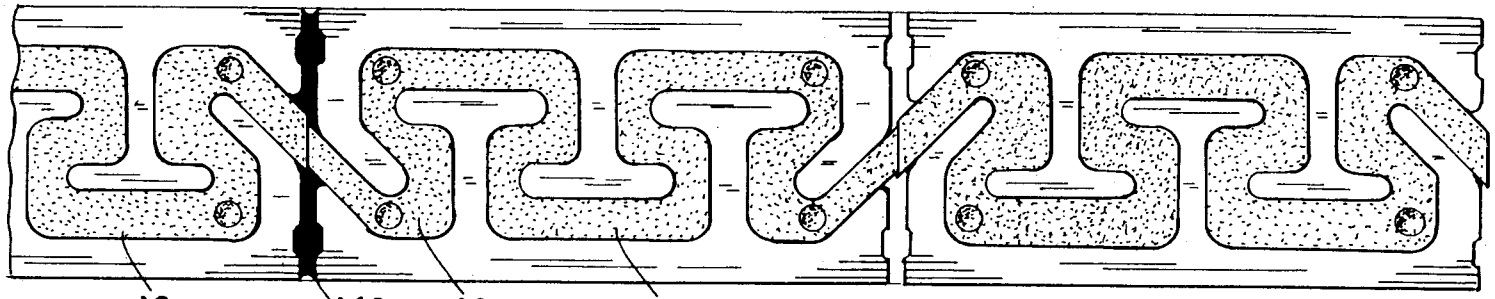
FIG. 10 is a top view of one means of joining two of the building blocks of FIG. 1 with the building block of FIG. 8.
Figure 11:
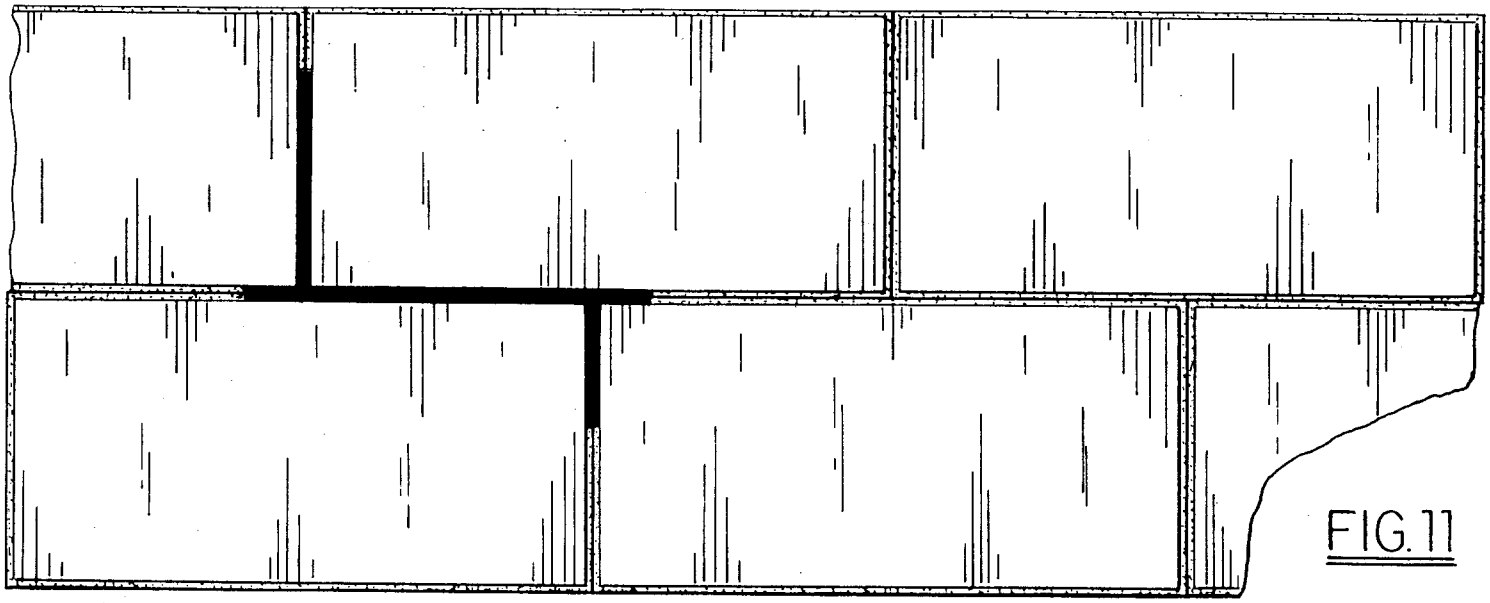
FIG. 11 illustrates a construction wall made from the building blocks of FIGS. 1 and 8.

FIG. 10 illustrates mortar 146 connecting two building blocks 10.

The building block 10 of this invention may be prepared with materialls, machines, and processes well known to those skilled in the art. Thus, by way of illustration and not limitation, one means for preparing a lightweight building block 10 is described below.

In this preferred embodiment, one may use 1,500 pounds of pumice, 2,500 pounds of sand, 530 pounds of 1-A cement, and water. The ingredients may be loaded into a mixer (available from Standly Batch Systems, Inc.) and mixed therein until a substantially homogeneous mixture is obtained. Thereafter, the mixture is then loaded into a hopper (available from Lithibar Matik, Inc.) which feeds the Besser block making machine described in a prior portion of this specification. The mixture is then shaken into a mold box (available from Rampf Mold Industries, Inc.) around a sinuous mold (available from Thermo Block, Inc. of Williamsville, New York) which is adapted to form the mixture into the shapes of block parts 12 and 14. The mixture in the mold is then pressed and vibrated while in the mold to facilitate the setting of the mixture to the proper desired block height. The "green block" so formed in the mold is then removed from the mold and fired in a kiln (Johnson Gas Appliance Company) at a temperature of 180 degrees Fahrenheit for at least about 6 hours. Thereafter, the fired blocks are allowed to cool. Thereafter, as is shown in FIG. 5, insert 16 is pressed into place between fired block parts 12 and 14.

Figure 12:
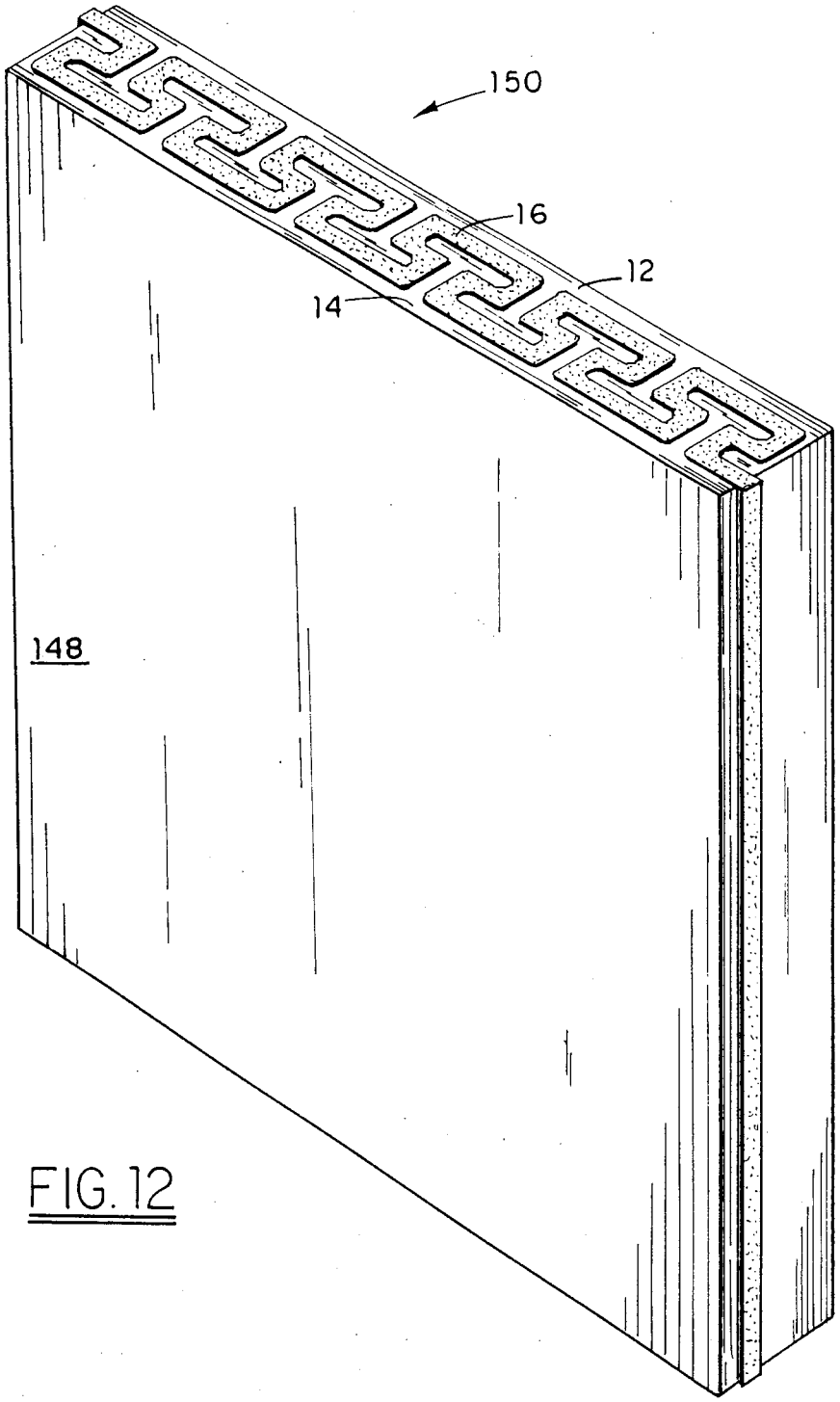
FIG. 12 illustrates a building panel.

Insert 16 is an integral, relatively lightweight structure adapted to form a multiplicty of interlocking projections with curvilinear structure. The term adapted to form, as used in this specification, refers to the shape of a mass which is poured into a mold around the insert. Thus, referring to FIG. 12, if insert 16 is placed into a rectangular mold 148 and concrete is poured into the mold and allowed to cure, a building panel 150 will be formed with interlockably connected building panel parts 12 and 14. Each of these building panel parts will have an interlocking shape defined by the exterior shape of the insert 16, and will contain a multiplicity of interlocking projections with curvilinear structure.

Referring again to FIG. 5, insert 16 is comprised of at least one projection 152 which is curvilinear. It also preferably is comprised of at least two thumb holes, 154 which facilitate the lifting of building block 10 once the insert has been wedged into place between block parts 12 and 14.

Insert 16 is a wedge-shaped structure with inwardly extending sides which are wider at the top 156 of the insert than at the bottom 158 of the insert. Insert 16 preferably consists of material with a density of from about 0.5 to about 4.0 pounds per cubic foot, a conductivity of from about 0.1 to about 0.35 British Thermal Units per inch per hour per square foot of surface area per degree Fahrenheit, having a flexural streength of from 25 to 125 pounds per square inch and a shear strength from 25 to 175 pounds per square inch. In a more preferred embodiment, insert 16 consists of material with a density of from about 1.0 to about 3.0 pounds per cubic foot, a tensile strength of from about 27 to about 125 pounds per square inch, a compressive strength of from about 11 to about 92 pounds per square inch, and a melting point of from not lower then about 140 degrees Fahreneheit and an R value of at least 3.5 R per inch. In an even more preferred embodiment, the material in the insert has a density of from about 1.0 to about 2.0 pounds per cubic foot, a tensile strength of from about 42 to about 80 pounds per square inch, a compressive strength of from about 20 to about 53 pounds per square foot, a melting point not less then 160 degrees Fahrenhiet, and an R value of at least about 5.5 R per inch. Some of these properties are discussed on pages 180–181 of Volume 7 of the "McGraw Hill Encylopedia of Science and Technology," supra, as well as in the references cited at the end of the article appearing in this document. Each of these publications is hereby incorporated by reference into this specification.

In one preferred embodiment, the foam material used is "STYOPOR", which is an expanded polystyrene bead, available from BASF Corporation of Parsippany, New Jersey. The polystyrene is expanded into a multicellular mass 42 times it original size. It has only one-sixth the weight of cork, but it will withstand hot water or temperatures above 170 degrees Fahrenheit.

By way of illustration and not limitation, the material in insert 16 may consist essentailly of urea formaldehyde, phenol formaldehyde, polystyrene, phenolic resins, polyurethane foam. and the like.

In one embodiment, the material in insert 16 consists essentially of at least one foam material. The term foam, as used in this specification, refers to a material with a spongelike, cellular structure and includes materials such as polystyrene foam, polurethane foam, flexible foamed thermoplastic elastomers, and the like. Reference may be had to, e.g., George S. Brady et al.s "Materials Handbook," Twelfth Edition (McGraw-Hill Book Company, New York, 1986), the disclosure of which is hereby incorporated by reference into this specification.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

Thus, for example, one may use the aforementioned mold from Thermo Block Inc. in the Besser Vibrapac V3R block machine to form the building block 10.

Thus, for example, one may use insert 16 as a mold component in the Besser Vibrapac V3R block machine to form the building block 10 directly.

Thus, for example blocks parts 12 and 14 may be arranged in interlocking relationship with each other and thus used as a mold to make insert 16 with a foam filling machine such as that available from, e.g., Elmar Industries, Inc. of New York.

Thus, for example, building block 10 may advantageously be used in constructions where superior earthquake resistance and/or superior moisture resistance are desired.

We Claim:

1. An insulated building block of substantially rectangular shape comprised of a first spaced outer supportive part, a second spaced outer supportive part, curvilinear means for laterally interlockably connecting said first spaced outer supportive part and said second space outer supportive part, and a substantially curvilinear, integral inner insulating portion, wherein:

(a) each of said first spaced outer supportive part and said second spaced outer supportive part extends along the length of said building block, is comprised of an inner surface defining a side of the space between said parts, and has a configuration which differs from the configuration of the other of said spaced outer supportive parts;

(b) said space between said first and second spaced outer supportive parts is substantially curvilinear in cross section as viewed from the top of said building block;

(c) said space between said first and second spaced outer supportive parts is wedge-shaped and is defined by walls which extend inwardly from the top of said building block to the bottom of said building block;

(d) said insulating portion is positioned within an substantially fills the space between said first spaced outer supportive part and said second spaced outer supportive part, thereby forming said susbstantially rectangular building block;

(e) said building block is comprised of two opposite planar sidewalls, two opposite planar ends, a planar top, and a planar bottom;

(f) each of said planar sidewalls is parallel to the other of said planar sidewalls, each of said planar ends, is parallel to the other of said planar ends, and said planar top is parallel to said planar bottom;

(g) said insulating portion is substantially centered between and extends beyond each of said two planar ends;

and (h) said insulating portion extends beyond at least one of said planar top surface and said planar bottom surface of said building block.

2. The insulating block as recited in claim 1, wherein said inner insulating material consists essentaily of at least one foam material.

3. The insulating block as recited in claim 2, wherein said inner insurating material has a density of from about 0.5 to about 4.0 pounds per cubic foot.

4. The insulating block as recited in claim 3, wherein said inner insulating material has a conductivity of from about 1.0 to about 0.35 British Thermal Units per inch hour per square foot of surface area per degree Fahrenheit.

5. The insulating block recited in claim 3, wherein said inner insulating material has a density of from about 1.0 to about 3.0 pounds per cubic foot.

6. The insulating block as recited in claim 5, wherein said inner insulating material has a tensile strength of from 27 to about 125 pounds per square inch.

7. The insulating block as recited in claim 6, wherein said inner insulating material has a compressive strength of from about 11 to about 92 pounds per square inch.

8. The insulating block as recited in claim 7, whrein said inner insulating material has a tensile strength of from about 42 to aobut 80 pounds per square inch.

9. The insulating block as recited in claim 8, wherein said inner insulating material has a flexural strength of from about 25 to about 125 pounds per square inch.

10. The insulating block as recited in claim 9, wherein said inner insulating material has a shear strength of about 25 to about 175 pounds per square inch.

11. The insulating block as recited in claim 10, wherein said inner insulating material has a melting point no lower than abut 140 degrees Fahrenheit.

12. The insulating block as recited in claim 11, wherein said inner insulating material has an R value of at least about 3.5 R per inch.

13. The insulating block as recited in claim 1, wherein each of said first outer supportive part and said second outer supportive part consist essentially of concrete or other aggregates commonly used in building blocks.

14. The insulating block as recited in claim 13, wherein each of said first outer supportive part and said second outer supportive part comprises at least one internal section so shaped as to enable a portion said supportive part to project within the confines of the other of said supportive part.

15. The insulating block as recited in claim 14, wherein each of said internal sections extends from the top of said building block to the bottom of said building block.

16. The insulating block as recited in claim 15, wherein each of said internal sections extends divergently from the top of said building block to the bottom of said building block.

17. The insulating block as recited in claim 16, wherein said inner insulating portion extends beyond said planar top surface of said building block.

18. The insulating block as recited in claim 16, wherein said inner insulating portion extends beyond said planar bottom surface of said building block.

19. The insulating block as recited in claim 16, wherein said inner insulating portion extends beyond both said planar top surface and said planar bottom surface of said building block.

20. The insulating block as recited in claim 17, wherein said inner insulating material has a density of from about 1.0 to about 2.0 pounds per cubic foot.

21. The insulating block as recited in claim 20, wherein said inner insulating material has a tensile strength of from about 42 to about 80 pounds per square inch.

22. The insulating block as recited in claim 21, wherein said inner insulating material has a compressive strength of from about 20 to about 53 pounds per square inch.

23. The insulating block as recited in claim 21, wherein said inner insulating material has an R value of at least about 3.5 R per inch.

* * * * *